US006752570B2

(12) United States Patent
Lanka

(10) Patent No.: US 6,752,570 B2
(45) Date of Patent: Jun. 22, 2004

(54) SHORING SYSTEM APPARATUS AND METHOD FOR SHORING

(76) Inventor: Richard Lanka, 1790 Enterprise Pkwy., Twinsburg, OH (US) 44087

( * ) Notice: Subject to any disclaimer, the term of this patent is extended or adjusted under 35 U.S.C. 154(b) by 0 days.

(21) Appl. No.: 10/225,593

(22) Filed: Aug. 22, 2002

(65) Prior Publication Data

US 2003/0190196 A1 Oct. 9, 2003

Related U.S. Application Data

(60) Provisional application No. 60/373,307, filed on Apr. 8, 2002.

(51) Int. Cl.[7] ..... E04G 25/04
(52) U.S. Cl. ..... 405/272; 52/127.2
(58) Field of Search ..... 52/127.2; 405/272, 405/282, 288, 290, 299, 273, 274, 276, 279

(56) References Cited

U.S. PATENT DOCUMENTS

| | | | | |
|---|---|---|---|---|
| 2,511,584 A | * | 6/1950 | Hill | 249/27 |
| 2,832,559 A | | 4/1958 | Hillberg | |
| 2,945,662 A | | 7/1960 | Jennings | |
| 3,154,833 A | | 11/1964 | Kimball | |
| 3,171,627 A | | 3/1965 | Tapley et al. | |
| 3,504,880 A | | 4/1970 | Toms | |
| 3,574,981 A | | 4/1971 | Henschen | |
| 3,788,026 A | | 1/1974 | Cook | |
| 3,817,006 A | | 6/1974 | Williams | |
| 4,000,592 A | | 1/1977 | Kelly | |
| 4,068,427 A | | 1/1978 | Camardo | |
| 4,070,833 A | | 1/1978 | Hancock | |
| 5,186,429 A | | 2/1993 | Linnepe et al. | |
| 5,314,157 A | | 5/1994 | Linnepe et al. | |
| 5,377,462 A | * | 1/1995 | Beals et al. | 52/127.2 |
| 5,388,663 A | | 2/1995 | Phillippe et al. | |
| 5,481,836 A | | 1/1996 | Miller et al. | |
| 5,943,830 A | * | 8/1999 | Truitt | 52/127.2 |
| 5,956,906 A | | 9/1999 | Berich et al. | |
| 6,065,254 A | | 5/2000 | Lanka | |
| 6,212,830 B1 | | 4/2001 | MacKarvich | |
| 6,247,273 B1 | | 6/2001 | Nickel | |
| 6,539,677 B1 | * | 4/2003 | Lanka | 52/127.2 |

FOREIGN PATENT DOCUMENTS

EP 527 110 * 2/1993

OTHER PUBLICATIONS

*Urban Search and Rescue Structures Specialist Field Operations Guide*, 2nd Edition, Aug. 1999, pp. IV–41 to IV–50, V–20 to V–22, V–26 to V–39 and V–42 to V–44, US Army Corps of Engineers, Readiness Support Center, San Francisco, CA 94105–2195.

* cited by examiner

*Primary Examiner*—Frederick L. Lagman
(74) *Attorney, Agent, or Firm*—Fay, Sharpe, Fagan, Minnich & McKee, LLP

(57) ABSTRACT

A shoring system to support a vertical surface is provided. The shoring system includes a main frame including a first end and a second end and a first member connected to the main frame near the first end. A first length adjuster is disposed in the first member and a second member is connected to the main frame near the second end. A second length adjuster is disposed in the second member and the first length adjuster and the second length adjuster connect to a base plate. A method for shoring a vertical surface is also provided.

9 Claims, 12 Drawing Sheets

SHORING SYSTEM APPARATUS AND METHOD FOR SHORING

CROSS REFERENCE TO RELATED APPLICATION

This application claims the benefit of U.S. Provisional application Serial No. 60/373,307, filed on Apr. 8, 2002.

FIELD OF THE INVENTION

The present invention relates to the art of shoring systems that are used to stabilize structures. More particularly, the present invention relates to a shoring system for use in stabilizing a vertical portion of a structure.

BACKGROUND OF THE INVENTION

When a catastrophic event, accident or force of nature, such as an earthquake, tornado, hurricane, flood, fire, or snow load occurs, building structures are often weakened. Such weakened structures may suddenly shift or collapse, endangering rescue workers, inspectors or other people in the vicinity. In addition, a shift or collapse may affect other structures that are nearby, either by hitting and directly damaging them or by weakening a common or adjacent foundation.

As a result, it is often necessary to support a weakened structure, commonly termed "shoring," quickly yet securely. The shoring of a vertical surface is often referred to as "raker" shoring. Shoring is a task that is often performed by rescue personnel, who may be engaged in multiple tasks simultaneously, such as extinguishing a fire, attending to victims and shoring a structure. Thus, a raker shoring system must be capable of being assembled quickly and easily.

It is also necessary for a shoring system to be transported easily, so that the rescue workers can bring the system in an emergency vehicle as close to the accident scene as possible and then hand-carry it to the exact location where it will be assembled. Although a shoring system that is light is easily transported, the system must still be strong to support the heavy load of a building structure for a fairly long period of time (often up to a few weeks or longer).

The surface to be supported is typically held in a substantially vertical position by members that rely upon a proximate horizontal surface, such as the ground, as an anchor point. However, differences in the slope of nearby ground from site to site dictate a system that is adjustable to compensate for the slope differences and still support the structure in a substantially vertical position. The adjustment must be easy and quick to perform to allow the system to properly support the structure before collapse occurs. Because the shoring system will be used to support vertical portions of a variety of structures, from relatively low vertical surfaces to high vertical surfaces, it is also desirable for the system to be adjustable in height.

A shoring system must also be dependable, as it may be used repeatedly throughout its lifetime. As a result, it is often desirable to have the shoring system include components that rely on mechanical force, rather than on pneumatic or hydraulic components.

Raker shoring systems of the prior art often include wood, such as two-by-four (2×4) or four-by-four (4×4) beams and pieces of plywood, that are wedged at an angle between the nearby ground and the vertical surface to be supported. These systems lack adjustability and are not durable, often being discarded after one shoring use.

It is therefore desirable to develop a shoring system that is strong, durable, adjustable and reusable, yet easy to set up and to transport.

BRIEF SUMMARY OF THE INVENTION

In an exemplary embodiment of the present invention, a shoring system to support a vertical surface is provided. The shoring system includes a main frame including a first end and a second end and a first member connected to the main frame near the first end. A first length adjuster is disposed in the first member and a second member is connected to the main frame near the second end. A second length adjuster is disposed in the second member and the first length adjuster and the second length adjuster connect to a base plate.

In another exemplary embodiment of the present invention, a shoring system to support a vertical surface is provided. The shoring system includes a first main frame including a first end and a second end and a first member connected to the main frame near the first end. A first length adjuster is disposed in the first member and a second member is connected to the main frame near the second end. A second length adjuster is disposed in the second support member and the first length adjuster and the second length adjuster are connected to a first base plate. A second main frame includes a first end and a second end and the first end is connected to the second end of the first main frame. A third member is connected to the second main frame near the second end and at least one extension is connected to the third member. A third length adjuster is disposed in one of the at least one extensions connected to the third member. A fourth member is connected to the first base plate and a fourth length adjuster is disposed in the fourth member. The third length adjuster and the fourth length adjuster are connected to a second base plate.

In yet another exemplary embodiment of the present invention, a shoring system to support a vertical surface is provided. The shoring system includes a first raker support, including a main frame including a first end and a second end, a first member connected to the main frame near the first end, a first length adjuster disposed in the first member, a second member connected to the main frame near the second end, a second length adjuster disposed in the second member, and the first length adjuster and the second length adjuster are connected to the base plate. A second raker support includes a main frame including a first end and a second end, a first member connected to the main frame near the first end, a first length adjuster disposed in the first member, a second member connected to the main frame near the second end, a second length adjuster disposed in the second member, and the first length adjuster and the second length adjuster are connected to a base plate. Cross braces extend between the first raker support and the second raker support and securing means connect the cross braces to each of the first raker support and the second raker support.

In still another exemplary embodiment of the present invention, a method for shoring a vertical surface is provided. The method includes the steps of placing a first main frame including a first end and a second end against a vertical surface, connecting a first member to the first end of the first main frame, connecting a second member to the second end of the first main frame, inserting a first adjuster leg into the first member, securing the first adjuster leg in the first member, inserting a second adjuster leg into the second member, securing the second adjuster leg in the second member, providing a base plate, connecting the first adjuster leg to the base plate, and connecting the second adjuster leg to the base plate.

There are other objects and features of the invention, which will be apparent from the following description and claims.

BRIEF DESCRIPTION OF THE FIGURES

The following is a brief description of the drawings, which are presented for the purpose of illustrating the invention and not for the purpose of limiting the same, and wherein.

DETAILED DESCRIPTION OF THE INVENTION

Figure 1:
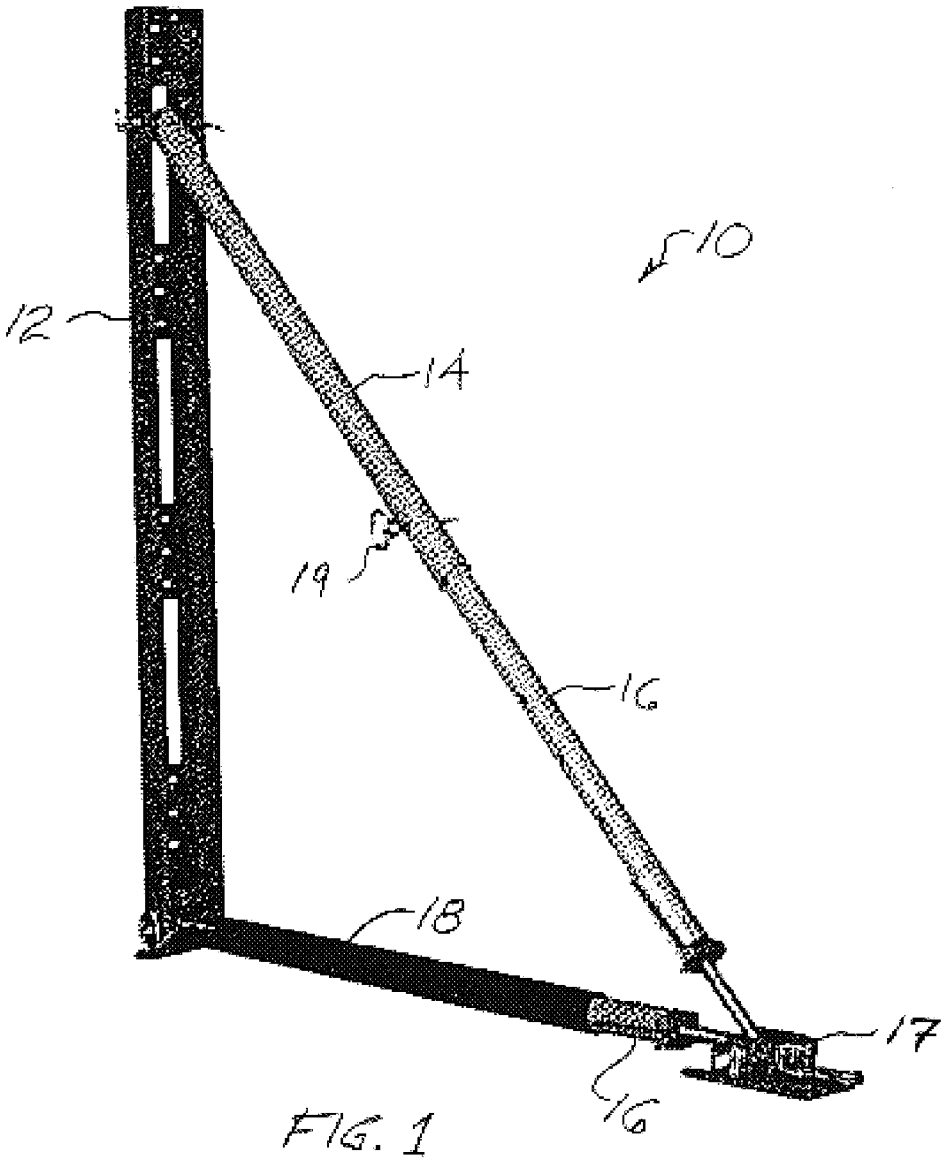
FIG. 1 is a perspective view of an assembled embodiment of the invention.

Referring now to the drawings, wherein the showings are for purposes of illustrating preferred embodiments of the invention and not for the purpose of particularly limiting the same, FIG. 1 illustrates a raker shoring system 10 to support a vertical structure. A main frame 12 is connected to a support leg 14. The support leg 14 receives an adjuster leg 16 that in turn connects to a base plate 17. The main frame also connects to an extension 18 that receives an adjuster leg 16, which also connects to the base plate 17. The connections may be removable and may be facilitated by pins 19 or other similar means, such as bolts. It is to be noted that the support leg 14 and the extension 18 may be interchangeable.

In this manner, the components of the shoring system 10 form a triangular support structure, where the main frame 12 is placed against the vertical surface to be supported and the base plate 17 is secured to a generally horizontal surface. The use of pins 19 for the connections allows the support leg 14 and the extension 18 to pivot so that the base plate 17 may be secured to horizontal surfaces of differing levels.

Figure 2:
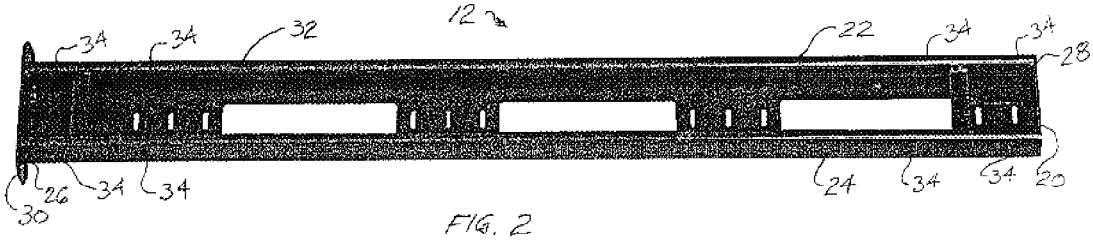
FIG. 2 is a perspective view of a component of the embodiment of FIG. 1.

Turning now to FIG. 2, the main frame 12 includes a planar surface 20 that is typically placed against the vertical surface to be supported. Extending from the planar surface 20 are parallel first 22 and second 24 sides and a first end 26 and second end 28. At the first end 26, flanges 30 may be present which allow multiple main frames 12 to be fastened together. The planar surface 20, first side 22, second side 24, first end 26 and second end 28 cooperate to define a channel 32 where the support leg 14 and extension 18 may be received. The first 22 and second 24 sides define orifices 34 that may receive pins, bolts or other fasteners 19 (FIG. 1) to secure the support leg 14 and/or the extension 18 to the main frame 12.

Figure 3:
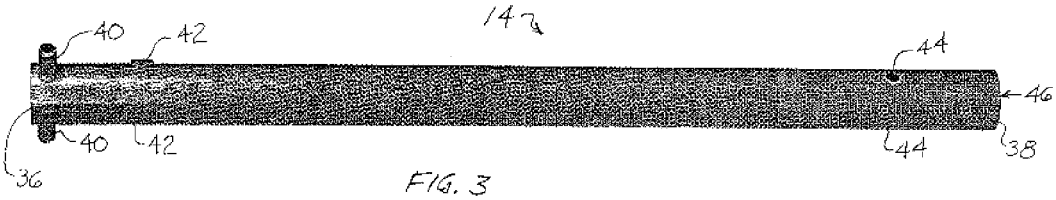
FIG. 3 is a perspective view of another component of the embodiment of FIG. 1.

With reference to FIG. 3, the support leg 14 may include a cylindrical configuration having a first end 36 and a second end 38. Shoulders 40 may be included near the first end 36 to allow the support leg 14 to fit relatively close between the sides 22 and 24 of the main frame 12 (FIG. 2), thereby reducing any tendency of the support leg 14 to shift along the length of a pin when fastened to the main frame 12. The support leg 14 may define multiple sets of orifices 42 and 44 to allow pins or fasteners 19 (FIG. 1) to be inserted in order to secure the support tube 14 to the main frame 12, or to secure other items to the support tube 12, as will be shown below. The support tube 14 also defines an inner diameter 46 to receive the adjuster leg 16 (FIG. 1).

Figure 4:
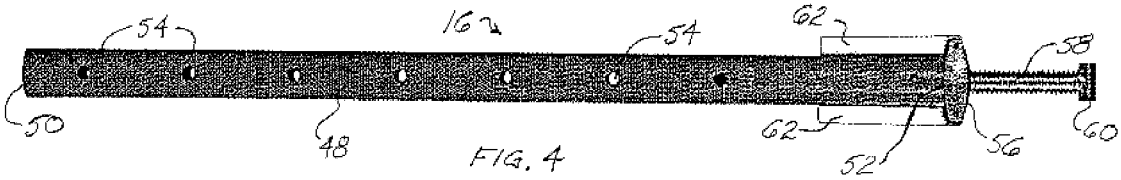
FIG. 4 is a side view of yet another component of the embodiment of FIG. 1.
Figure 5:
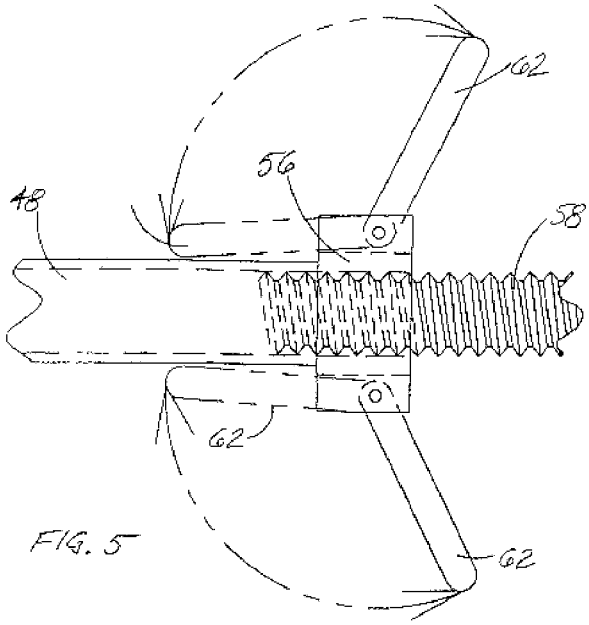
FIG. 5 is a side view, partially in section, of a portion of the component shown in FIG. 4.

As illustrated in FIGS. 4 and 5, the adjuster leg 16 includes a body 48 having an outer diameter that is slightly less than the inner diameter 46 of the support leg 14 (FIG. 3), thereby allowing the adjuster leg 16 to slide inside of the support leg 14. The adjuster leg 16 includes a first end 50 and a second end 52. The first end 50 is typically inserted into the support leg 14, while a tapped end cap 56 at the second end 52 prevents the adjuster leg 16 from sliding completely within the support leg 14.

The body 48 of the adjuster leg 16 defines multiple sets of orifices 56 that at least partially correspond to some of the orifices 44 that are defined in the support leg 14 to provide length adjustment. In this manner, a desired set of orifices 54 in the adjuster leg 16 may be aligned with a set of orifices 44 in the support leg 14 and a pin or other fastener 19 (FIG. 1) may be inserted through the aligned sets of orifices 44 and 54 to secure the adjuster leg 16 to the support leg 14 in a position that creates a desired overall length.

For fine adjustment of the length of the adjuster leg 16, a screw 58 engages the tapped end cap 56. The screw 58 terminates in a socket 60 that receives a pin or other fastener 19 (FIG. 1), thereby allowing the adjuster leg 16 to be removably secured to the base plate 17. Handles 62 are pivotally connected to the tapped end cap 56 and allow the tapped end cap 56 to be rotated, causing the screw 58 to move in or out of the adjuster body 48. Thus, once the adjuster leg 16 is connected to the support leg 14 at one end and near the base plate 17 at the other, the handles 62 may be turned to provide fine adjustment.

Figure 6:
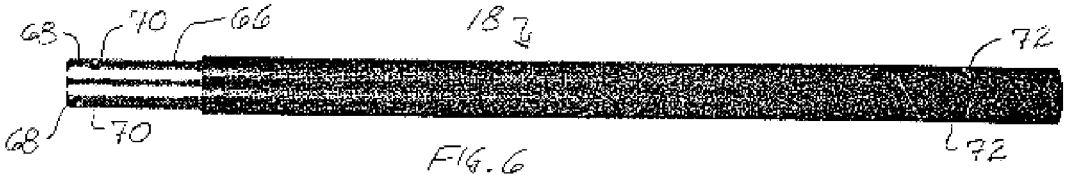
FIG. 6 is a side view of still another component of the embodiment of FIG. 1.

Turning to FIG. 6, the extension 18 is generally of an outer dimension approximate to that of the support leg 14, but also includes a shoulder 66 that is of a dimension that allows the shoulder 66 to slide inside of the support leg 14 or another extension, as will be described below. A first set of orifices 68 may be defined in the shoulder 66 to allow a pin or other fastener 19 (FIG. 1) to secure the extension 18 to the main frame 12 (as shown in FIG. 1).

A second set of orifices 70 may be defined in the shoulder 66 and align with a set of orifices 44 in the support leg 14, allowing a pin or other fastener 19 to secure the extension 18 to the support leg 14, also to be described below. A third set of orifices 72 may be defined in the extension 18 that align with a desired set of orifices 54 in the adjuster leg 16, allowing an adjustable connection between the extension 18 and the adjuster 16 that is substantially similar to that described above for the support leg 14 and the adjuster leg 16. The locations of the orifices 68, 70 and 72 may shift or change according to specific design requirements. For example, only one set of the first two sets of orifices 68 and 70 may be present for some applications, thereby shifting along the shoulder 66 as design considerations dictate.

Figure 7:
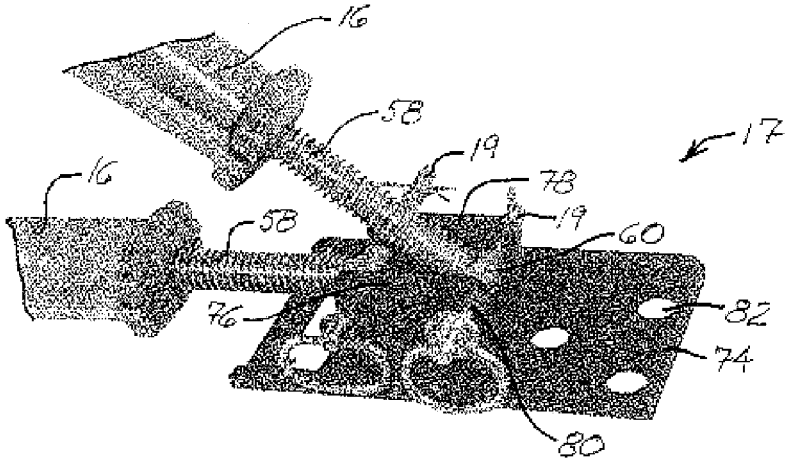
FIG. 7 is a perspective view of yet another component of the embodiment of FIG. 1.

With reference to FIG. 7, the base plate 17 facilitates the interconnection of the support members and allows them to be anchored to the ground. The base plate 17 includes a bottom plate 74 that contacts the ground, while parallel flanges 76 and 78 extend in a direction normal to the bottom plate 74. The flanges 76 and 78 are spaced apart and define orifices 80 that align with the socket 60 of each adjuster legs 16, allowing the adjuster legs 16 to be pinned to the base plate 17. The bottom plate also defines orifices 82 that allow it to be anchored to the ground or other stable horizontal surface.

Figure 8:
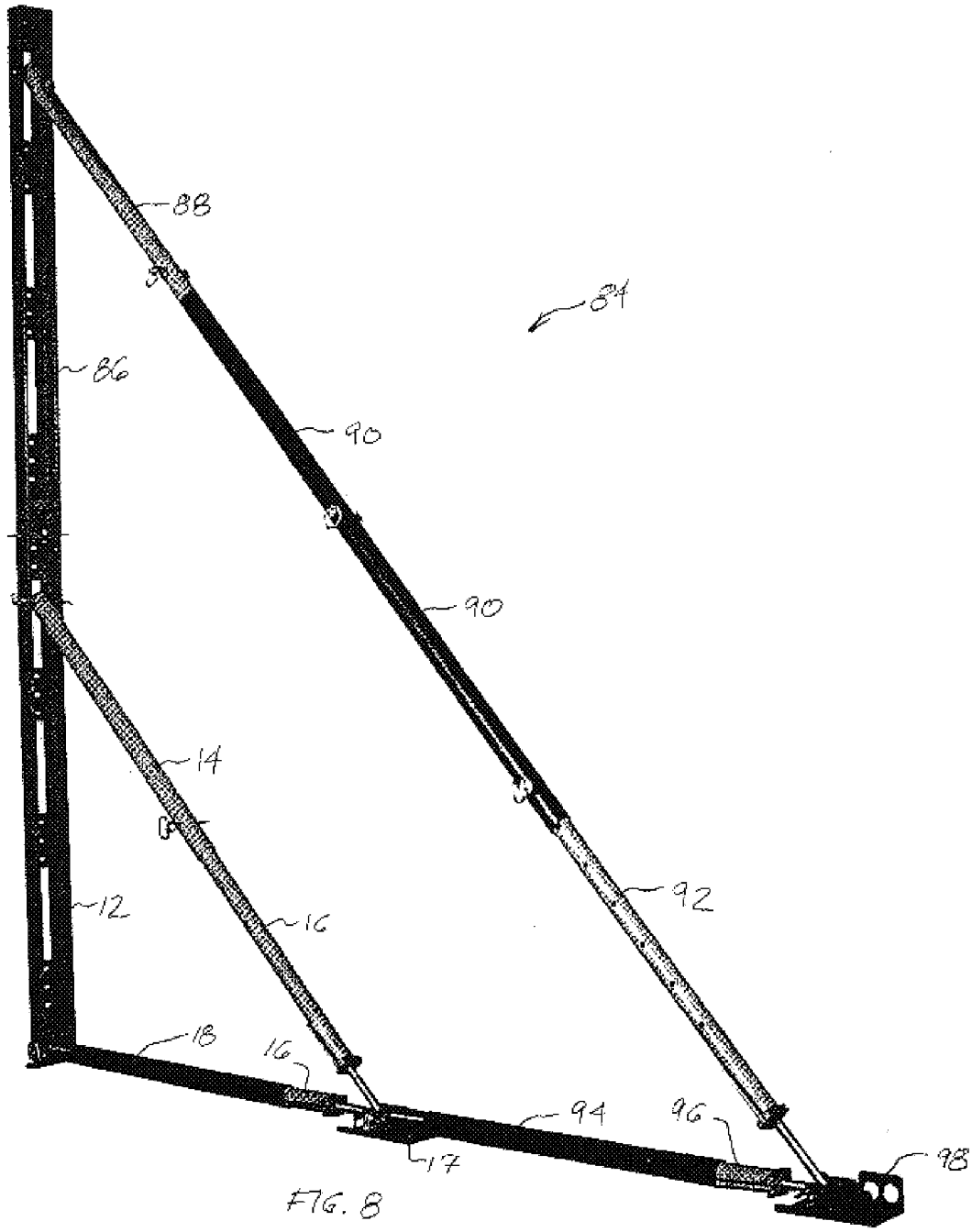
FIG. 8 is a perspective view of another assembled embodiment of the invention.

As FIG. 8 illustrates, when a high vertical surface must be supported, an extended shoring system 84 may be used. The main frame 12 includes flanges 30 to allow a second main frame 86 to be bolted or fastened to the original main frame 12. A second support leg 88 is pivotally connected to the second main frame 86 and at least one second extension 90 is inserted into the second support leg 88. The shoulder (not shown) of the second extension 90 is inserted in the inner diameter of the second support leg 88 and the second extension 90 is pinned in place.

As illustrated, two second extensions 90 may be used in series to provide an adequate length to support the second main frame 86. A second adjuster leg 92 is inserted into the last extension 90, and pinned into place, as described above. An additional horizontal extension 94 is pinned in between the flanges 76 and 78 of the base plate 17, which may include about three sets of orifices 80. The additional horizontal extension 94 receives an additional horizontal adjuster leg 96, which is pinned in place. The sockets of the second adjuster leg 92 and the additional horizontal extension leg 96 are pinned or otherwise secured to a second base plate 98, which may be anchored to the ground or horizontal support surface.

In this manner, an extended shoring system 84 may allow substantially high vertical surfaces to be supported. Through the use of additional components, an overall extension of height may be accomplished to adapt the system to the height needed to support a weakened structure.

The above-described shoring system 10 thus provides a strong, adjustable structure of modular components for easy storage and transport. Furthermore, the system 10 is easily assembled and adjusted. Accordingly, a method of supporting a vertical surface or structure with the shoring system 10 is disclosed by the above figures.

A first main frame 12 is placed substantially against the vertical surface to be supported. The first end 36 of the support leg 12 is placed into the channel 32 of the main frame 12 and the shoulders 40 of the support leg 12 are aligned with orifices 34 near the first end 26 of the main frame 12 and secured with a pin or other fastener 19. The shoulder 66 of the extension 18 is placed into the channel 32 of the first main frame 12 and the orifices 68 in the shoulder 66 are aligned with orifices 34 near the second end 28 of the first main frame 12 and secured with a pin or other fastener 19.

The first end 50 of a first adjuster leg 16 is placed in the second end 38 of the support leg 14 and a set of orifices 54 in the first adjuster leg 16 is aligned with the orifices 44 in the support leg 14 to create a desired overall length, whereupon a pin 19 is inserted through the orifices 44 and 54 to secure the first adjuster leg 16 to the support leg 14. The first end 50 of a second adjuster leg 16 is placed in the extension 18 and a set of orifices 54 in the second adjuster leg 16 is aligned with the orifices 72 in the extension 18 to create a desired overall length, whereupon a pin 19 is inserted through the orifices 72 and 54 to secure the second adjuster leg 16 to the extension 18.

The base plate 17 is placed so that the sockets 60 of both adjuster legs 16 are in between the flanges 76 and 78 of the base plate 17. The sockets 60 are aligned with orifices 80 that are defined in the flanges 76 and 78 and pins 19 are inserted through the sockets 60 and the orifices 80 to secure the adjuster legs 16 to the base plate 17.

It is to be noted that the main frame 12 may be raised or lowered to a suitable area on the surface to be supported and then secured to the surface, and the base plate 17 may also be raised or lowered to a suitable surface to which it may be secured. This flexibility in adjustment is facilitated by the pin connections. Further adjustment is provided by turning the handles 62 on the adjuster legs 16 or realigning and re-pinning the orifices 54 in the adjuster legs 16, or both.

The method also includes the use of the extended shoring system 84, which involves placement of the additional main frame 88, extensions 90 and 94, adjuster legs 92 and 96 and base plate 98 as described above.

The steps of the method of using the shoring system 10 and 84 may be performed in alternate ways. For example, the adjuster leg 16 may be inserted into the support leg 14 and then the support leg 14 may be pinned to the main frame 12. In addition, some components are interchangeable for some functions. For example, the support leg 14 may be used in the place of the extension 18, or the extension 18 may be used in the place of the support leg 14.

The components of the system 10 and 84 may also be color-coded for easy recognition. For example, the main frame 12 may be red, the support leg 14 gray and the extension 18 blue.

Figure 9:
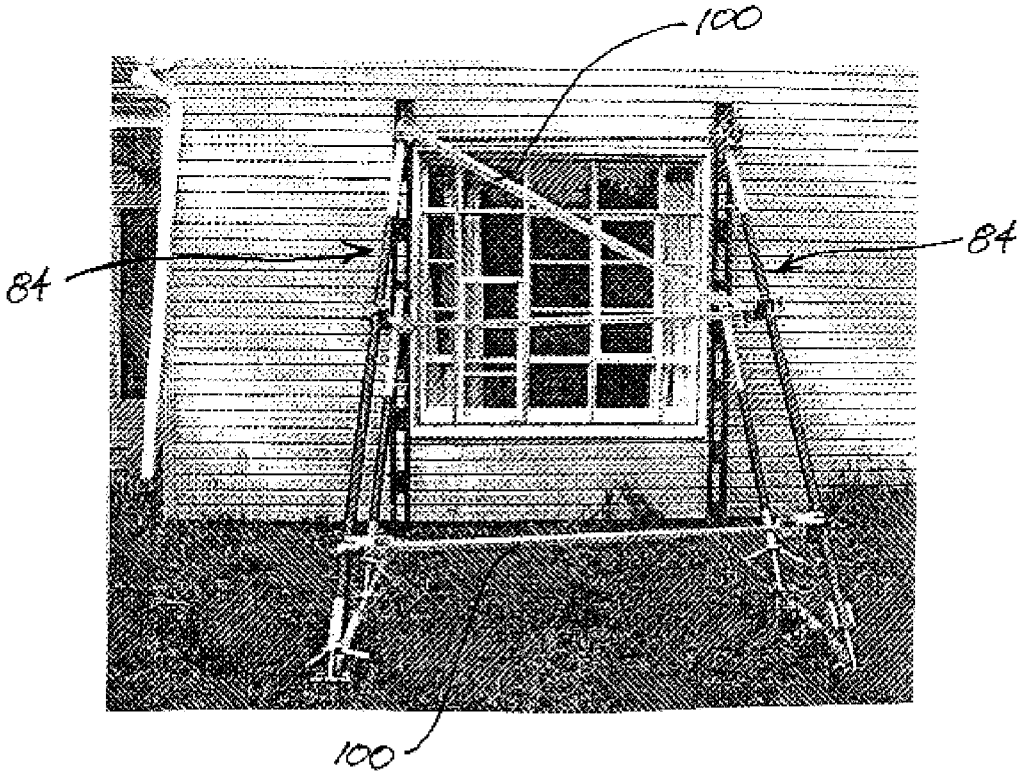
FIG. 9 is a perspective view of another assembled embodiment of the invention in use.

Turning now to FIG. 9, it may be desirable to use multiple shoring systems 84 to support a vertical surface across an extended length. These systems 84 may be placed independently, i.e., without interconnection to one another, or they may be connected to one another to provide increased stability. When the systems 84 are interconnected, cross braces 100 may be used. The cross braces 100 are connected at one end to one shoring system 84 and at the opposite end to a separate shoring system 84.

Figure 10:
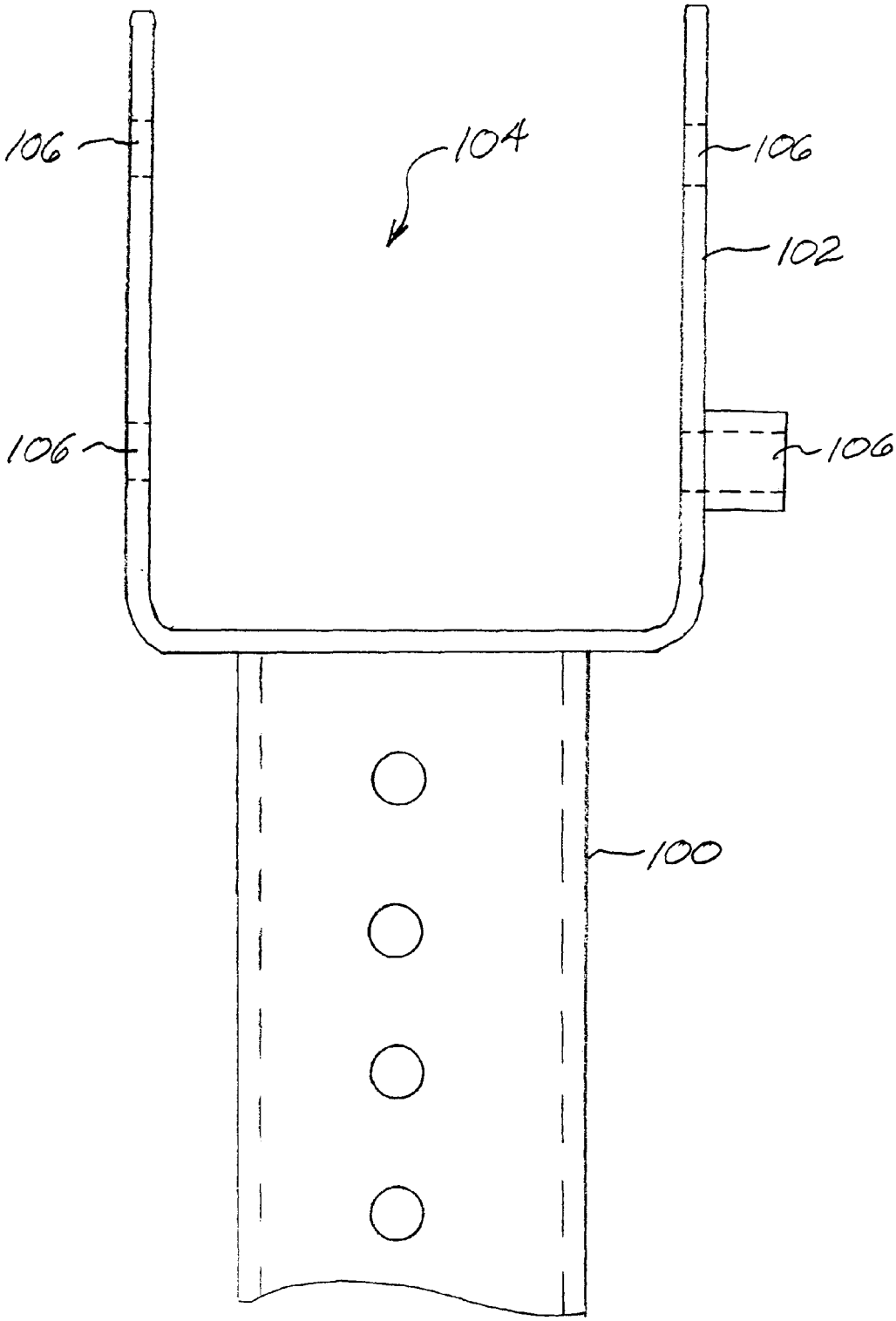
FIG. 10 is a front view of a portion of a component of the embodiment of the invention shown in FIG. 9.

With reference to FIG. 10, a cross brace 100 may include a bracket 102 that defines a channel 104 that may receive a support leg 14, an adjuster leg 16 or an extension 18. The bracket 102 also defines orifices 106 that allow a pin or other fastener to secure the cross brace 100 to the support leg 14, adjuster leg 16 or extension 18 to which it connects.

Figure 11:
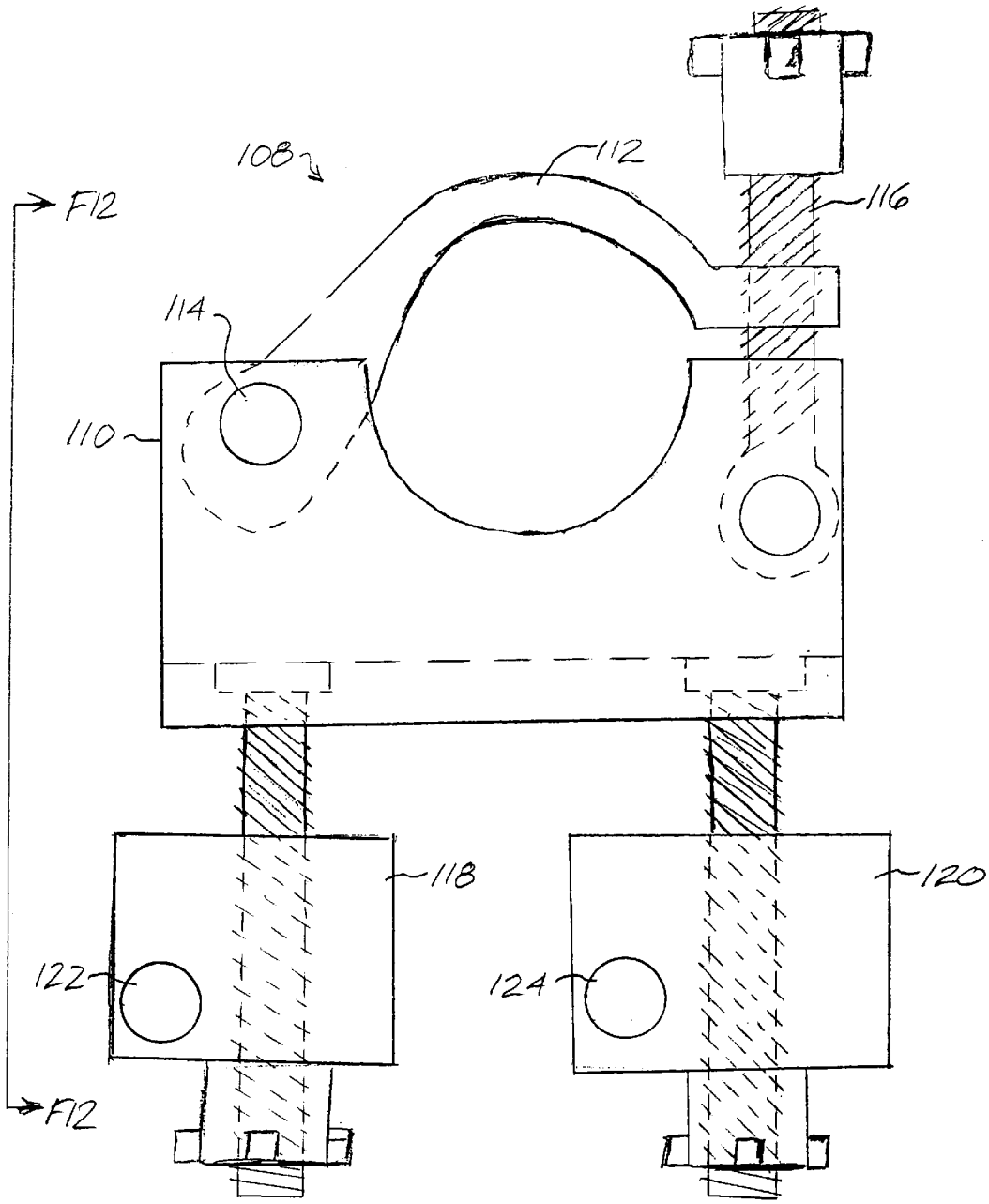
FIG. 11 is a front view of another component of the embodiment of the invention shown in FIG. 10.
Figure 12:
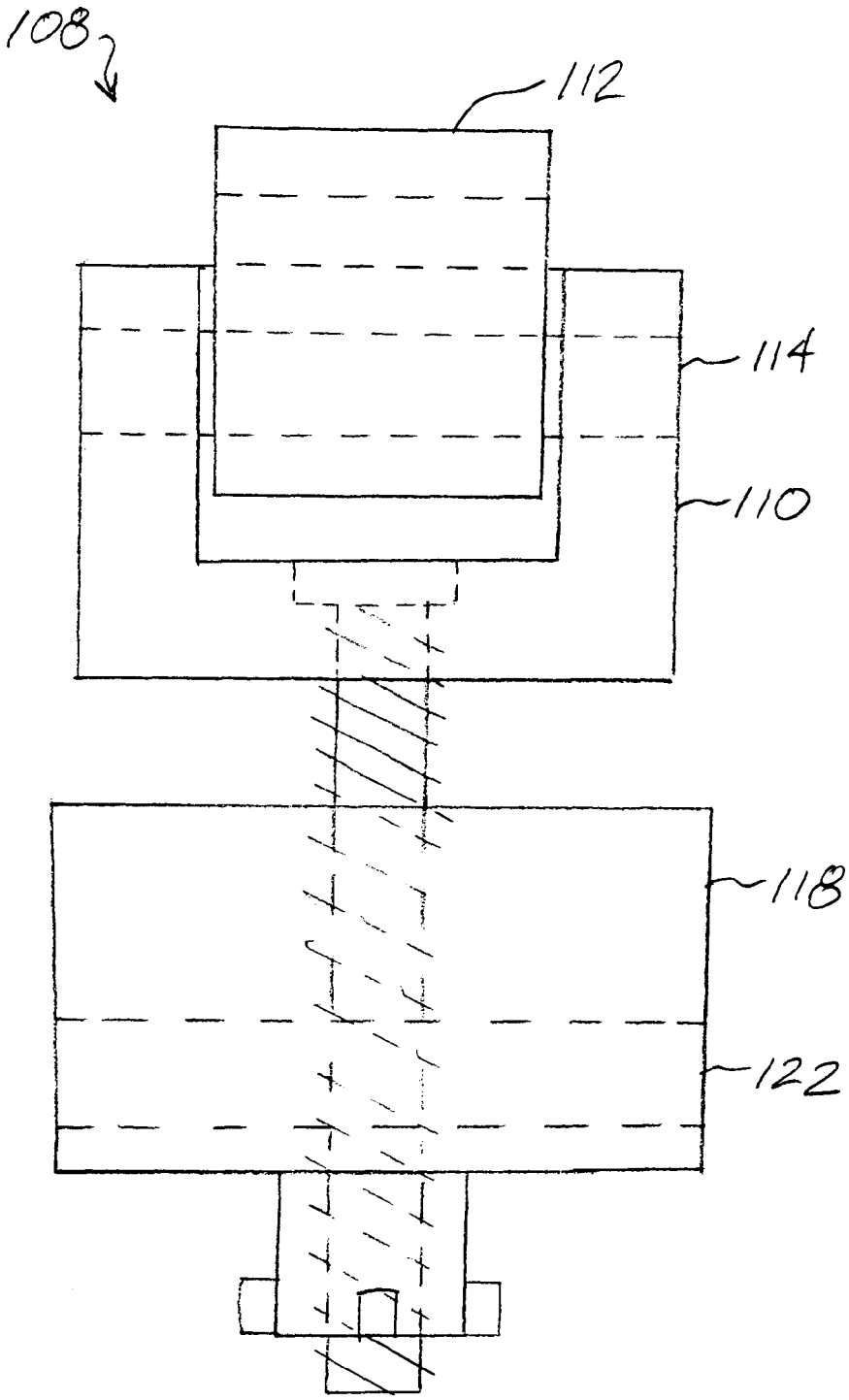
FIG. 12 is a side view of the component of FIG. 11 along line F12—F12.
Figure 13:
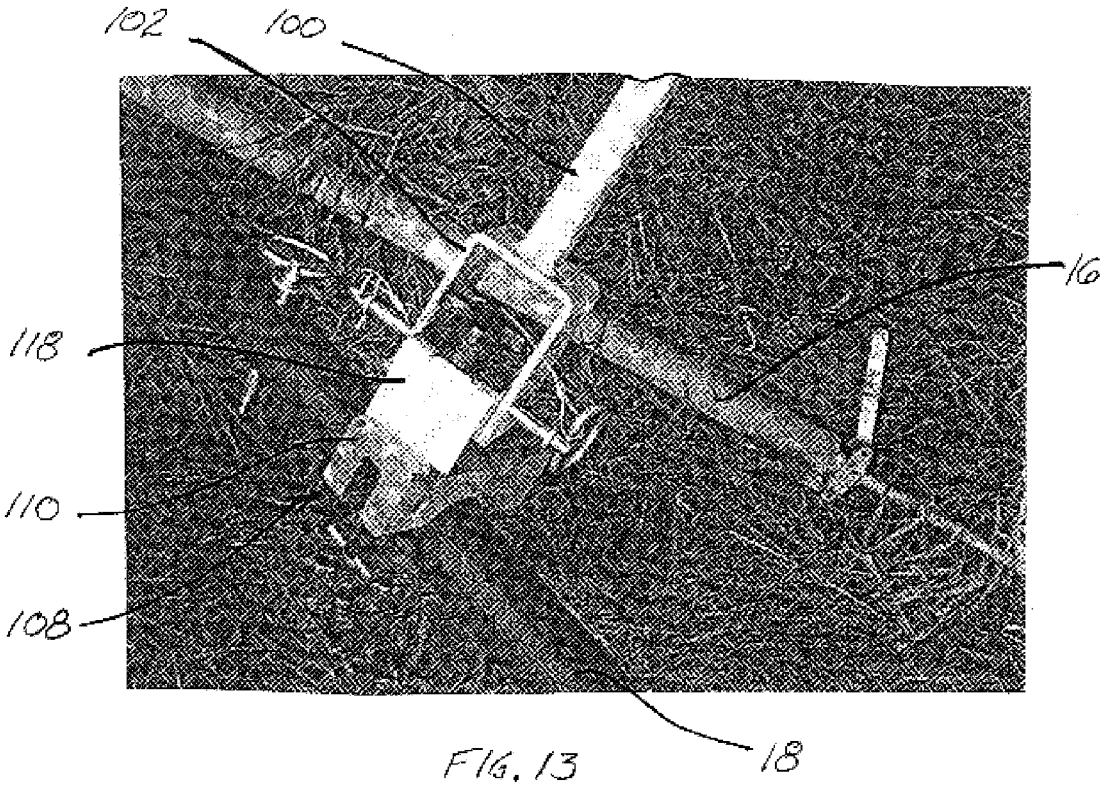
FIG. 13 is a perspective view of the components of FIGS. 10 and 11 in use.

With reference to FIGS. 11–13, a clamp 108 may also be included to secure the cross brace 100 to the support leg, 14, adjuster leg 16 or extension 18. The clamp 108 may provide more flexibility as to the location and orientation of the connection of the cross brace 100. The clamp 108 includes a body 110 that is pivotally connected to a securing member 112 at a hinge point 114. The securing member 112 is pivoted away from the body 110 to allow the clamp 108 to engage the desired support leg 14, adjuster leg 16 or extension 18. When the desired leg or extension 14, 16 or 18 is engaged, the securing member 112 is closed about the leg or extension 14, 16 or 18, thereby causing the clamp 108 to substantially surround a section of the leg or extension 14, 16 or 18. Fastening means, such as a threaded pin 116 and nut (not shown) may secure the clamp 108 in a closed position.

A first pivotable connector 118 and a second pivotable connector 120 are connected to the body 110 and define respective orifices 122 and 124 to receive pins. The pivotable connectors 118 and 120 engage the channel 104 defined by the bracket 102 of the cross brace 100. The orifices 122 and 124 defined in the pivotable connectors 118 and 120 align with orifices 106 defined in the bracket 102, allowing a pin to secure the pivotable connectors 118 and 120 to a respective cross brace 100.

Two different cross braces may be used, with each one having a bracket 102 as described. One cross brace may be of a different diameter than the other, to allow the smaller brace to slide inside the other and be adjustably pinned. In this manner, an adjustable assembly including two cross braces may have a bracket 102 at either end.

Figure 14:
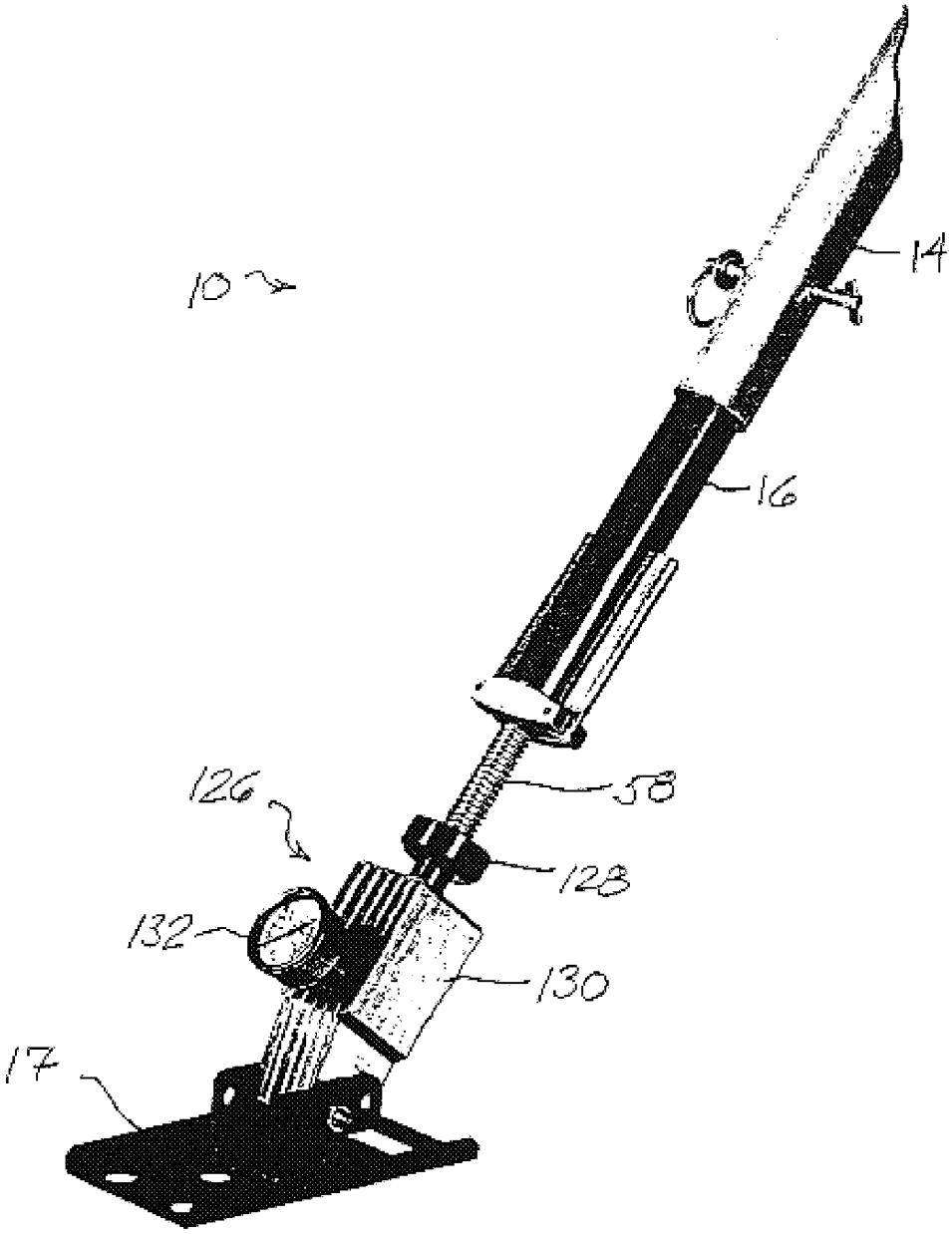
FIG. 14 is a perspective view of a component of still another embodiment of the invention.

As FIG. 14 shows, a pressure gauge 126 may be included in the shoring system 10. The pressure gauge 126 includes a collar 128 that receives the screw 58 of the adjuster leg 16. The screw 58 extends into the body 130 of the pressure gauge 126 and into a sealed cavity (not shown) defined therein. At least part of the pressure exerted by the supported surface is transferred via the main frame (not shown), down the support leg 14, down the adjuster leg 16 and down the screw 58 into the sealed cavity 130. The pressure is shown by the indicator 132, which is in contact with the sealed cavity. Thus, the pressure gauge 126 allows the pressure exerted by the supported surface to be monitored for changes as well as magnitude.

Figure 15:
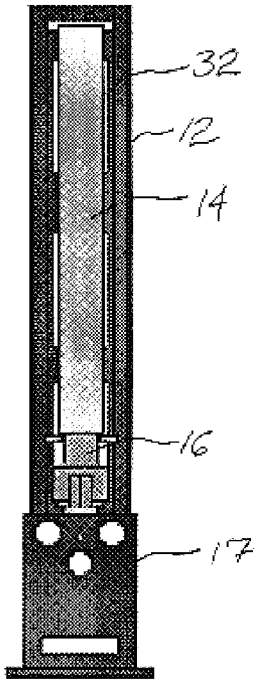
FIG. 15 is a front view of several components of the present invention folded for storage and/or transport.
Figure 16:
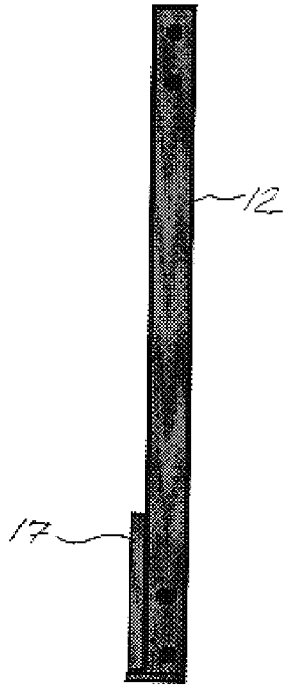
FIG. 16 is a side view of the several components of FIG. 15.

Turning to FIGS. 15 and 16, the ability of the components of the system to be folded into compact units for transport and storage when the main frame 12 is used is shown. The adjuster leg 16 slides into the support leg 14, which may be pivotally connected to the main frame 12. The support leg 14 and adjuster leg 16 may be folded or placed in the channel 32 defined by the main frame 12, wherein the assembly is contained within the walls of the main frame 12. The base plate 17 may then flip up and hook onto the main frame 12 to be secured to the main frame 12 and hold the adjuster leg 16 and the support leg 14 in place.

The invention has been described with reference to preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A shoring system to support a vertical surface, comprising:

a main frame including a first end and a second end;

a first member connected to the main frame near the first end;

a first length adjuster disposed in the first member;

a second member connected to the main frame near the second end;

a second length adjuster disposed in the second member;

a base plate, wherein the first length adjuster and the second length adjuster connect to the base plate; and a pressure gauge connected to at least one of the first and second length adjusters; and wherein, at least one of the first and second members comprises a support leg;

at least one of the first and second members comprises an extension;

at least one of the connections is removable at least one connection includes a pin; and at least one of the first and second length adjusters includes an adjustable screw.

2. The shoring system of claim 1, wherein one of the first and second members is capable of being selectively rotated into the main frame for storage.

3. The shoring system of claim 2, wherein the base plate secures the member in the main frame.

4. A shoring system to support a vertical surface, comprising:

a first main frame including a first end and a second end;

a first member connected to the main frame near the first end;

a first length adjuster disposed in the first member;

a second member connected to the main frame near the second end;

a second length adjuster disposed in the second support member;

a first base plate, wherein the first length adjuster and the second length adjuster connect to the base plate;

a second main frame including a first end and a second end, wherein the first end is connected to the second end of the first main frame;

a third member connected to the second main frame near the second end;

at least one extension connected to the third member;

a third length adjuster disposed in one of the at least one extensions connected to the third member;

a fourth member is connected to the first base plate;

a fourth length adjuster disposed in the fourth member; and a second base plate, wherein the third length adjuster and the fourth length adjuster connect to the second base plate.

5. The shoring system of claim 4, wherein at least one of the first, second, third and fourth members comprises a support leg.

6. The shoring system of claim 4, wherein at least one of the first, second, third and fourth members comprises an extension.

7. The shoring system of claim 4, wherein the at least one connection includes a pin.

8. A method for shoring a vertical surface, wherein at least one of the first and second members is one of a support leg and an extension, comprising the steps of:

placing a first main frame including a first end and a second end against a vertical surface;

connecting a first member to the first end of the first main frame;

connecting a second member to the second end of the first main frame;

inserting a first adjuster leg into the first member;

securing the first adjuster leg in the first member;

inserting a second adjuster leg into the second member;

securing the second adjuster leg in the second member;

providing a base plate;

connecting the first adjuster leg to the base plate;

connecting the second adjuster leg to the base plate;

adjusting the length of the first adjuster leg; and adjusting the length of the second adjuster leg.

9. The method for shoring a vertical surface of claim 8, wherein at least one of the connections includes a pin.

* * * * *